US005914742A

United States Patent [19]

Weidert

[11] Patent Number: 5,914,742

[45] Date of Patent: Jun. 22, 1999

[54] PRIMARY CHARGE ROLLER WITH PROTRUDING END

[75] Inventor: Edward Wayne Weidert, Superior, Colo.

[73] Assignee: Lexmark International, Inc., Lexington, Ky.

[21] Appl. No.: 08/757,396

[22] Filed: Nov. 27, 1996

[51] Int. Cl.[6] ..... G03G 15/02

[52] U.S. Cl. ..... 347/153; 399/176

[58] Field of Search ..... 347/153; 250/208.6; 313/523; 399/26, 176, 313

[56] References Cited

U.S. PATENT DOCUMENTS

| | | |
|---|---|---|
| 5,241,343 | 8/1993 | Nishio . |
| 5,384,626 | 1/1995 | Kugoh et al. . |
| 5,390,007 | 2/1995 | Kugoh et al. . |
| 5,440,374 | 8/1995 | Kisu . |
| 5,450,171 | 9/1995 | Demura et al. . |
| 5,459,558 | 10/1995 | Ishiyama . |
| 5,467,178 | 11/1995 | Mui et al. . |
| 5,483,323 | 1/1996 | Matsuda et al. . |
| 5,485,344 | 1/1996 | Matsumoto et al. . |
| 5,506,745 | 4/1996 | Litman . |
| 5,534,344 | 7/1996 | Kisu et al. . |
| 5,541,711 | 7/1996 | Kisu et al. . |
| 5,543,899 | 8/1996 | Inami et al. . |
| 5,567,494 | 10/1996 | Ageishi et al. . |

FOREIGN PATENT DOCUMENTS

| | | | |
|---|---|---|---|
| 63-208879 | 8/1988 | Japan | G03G 15/02 |
| 4-025870 | 1/1992 | Japan | G03G 15/02 |
| 6-295116 | 10/1994 | Japan | G03G 15/02 |

*Primary Examiner*—Benjamin R. Fuller
*Assistant Examiner*—Raquel Yvette Gordon
*Attorney, Agent, or Firm*—John A. Brady

[57] ABSTRACT

A primary charge roller configuration with an annular lip protruding from the roll core prevents wear of the roller edges into the photoconductive drum. The gap between the lip and the shaft created by the lip can be void or can be filled with a soft material, such as EPDM or SBR.

20 Claims, 3 Drawing Sheets

PRIMARY CHARGE ROLLER WITH PROTRUDING END

This invention pertains to a primary charge roller for use in an electrophotographic device, such as a laser printer. Particularly, it pertains to a primary charge roller configuration wherein the primary charge roller includes a lip protruding axially from at least one of its ends.

BACKGROUND OF THE INVENTION

Generally in an image formation apparatus, such as a laser printer, the following processes are performed:

a) a uniform distribution of electrical charges is produced on a surface of an electrostatic latent image carrying body;

b) an electrostatic latent image is formed on a charged area of the image carrying body surface by an optical writing means such as a laser beam scanner, an LED (light emitting diode) array, a liquid crystal shutter array or the like;

c) the latent image is developed as a visible image with a developer or toner which is electrically charged to electrostatically adhere to the latent image zone;

d) the developed and charged toner image is electrostatically transferred from the surface of the image carrying body to a recording medium such as a cut sheet of paper; and e) the transferred toner image is fixed and recorded on the cut sheet of paper by a toner image fixing means such as a heat roller.

Typically the electrostatic latent image carrying body may be an electrophotographic photoreceptor. The receptor is usually formed as a drum, called a photoconductive drum. The photoconductive drum typically has a cylindrical conductive surface and a photoconductive insulating film bonded to the cylindrical conductive surface. In the charging process, an electric discharger, typically called a primary charge roller, is used to produce the charged area on the photoconductive drum. Such a primary charge roller is typically aligned adjacent to and parallel to the photoconductive drum such that it is in contact with the photoconductive drum along substantially the entire length of the primary charge roller. The primary charge roller must contact the photoconductive drum so as to fully charge the surface of the photoconductive drum.

Typically, laser printers include a replaceable cartridge. The cartridge includes the photoconductive drum, the primary charge roller, toner, and a developer roll. The cartridge is replaced periodically as required when a part or parts fail, or the toner has been completely used. A cartridge can typically last as long as 17,000–24,000 copies at 2.5% coverage per copy. One type of premature failure involving the photoconductive drum and the primary charge roller is called knife edge failure or black line short. The edge of the charge roller contacting the photoconductive drum wears a groove into the photoconductive drum such that the surface of the photoconductive drum cannot be evenly charged. This produces a black line on each page that is printed. It can also destroy both the primary charge roller and/or the photoconductive roll, thereby rendering the cartridge useless.

Various attempts to prevent this premature wearing of the photoconductive drum by the edges of the primary charge roller have been made. For example, radii or chamfers have been provided on the edges of the primary charge roller. The present invention eliminates the need for such a radius or chamfer, while preventing knife edge failure.

Numerous primary charge roller configurations are used in the art. Variations in configuration have been made to address different issues with the primary charge roller and the photoconductive drum. For example, U.S. Pat. No. 5,541,711, Kisu et al., issued Jul. 30, 1996, discloses a charging member having an internal cavity. This internal cavity is intended to eliminate noise that can be produced when the photoconductive drum is charged. This cavity is defined by the metal shaft about which the charging roller rotates and the outer surface of the charging roll. The internal cavity extends substantially the entire length of the charging roller and occupies a substantial volume of the charging roller. The cavity described in the patent addresses a different problem than the knife edge failure addressed by the present invention. Furthermore, the patent discloses an internal cavity completely enclosed within the charge roller. In contrast, the present invention requires a gap that is defined on three sides, but open on the fourth side. The present invention does not encompass a primary charge roller configuration wherein the fourth side of the gap is also enclosed.

SUMMARY OF THE INVENTION

The present invention provides a primary charging roller for charging a photoconductive drum comprising a shaft and a roll core disposed about said shaft and extending along a portion of the length of said shaft, wherein said roll core has a first and second end and wherein at least one of said ends includes an annular lip protruding axially from said roll core such that a gap is formed between said roll core and said shaft, wherein said annular lip completely encircles the shaft.

The invention further provides a laser printer cartridge comprising a photoconductive drum and a primary charge roller wherein said primary charge roller comprises a shaft and a roll core disposed about said shaft and extending along a portion of the length of said shaft, wherein said roll core has a first and second end and wherein at least one of said ends includes an annular lip protruding axially from said roll core such that a gap is formed between said roll core and said shaft, wherein said annular lip completely encircles the shaft.

DETAILED DESCRIPTION OF PREFERRED EMBODIMENTS

Figure 3:
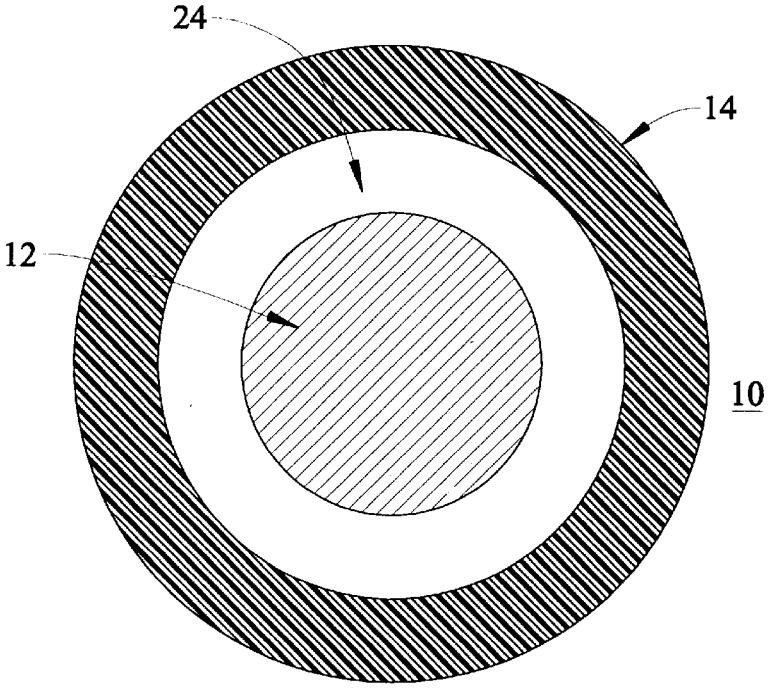
FIG. 3 is an end elevational view of the primary charge roller without a coating.

Primary charge rollers 10 are well-known in the art. See FIGS. 1 and 3. Any primary charge roller 10 known in the art can be modified to be used in the present invention. A primary charge roller 10 comprises a shaft 12 and a roll core 14. The shaft 12 must be made of a material that provides sufficient stiffness and strength to support a roll core 14 so that the roll core 14 contacts the photoconductive drum along substantially the entire length of the roll core 14. The shaft 12 can be made of metals, glass or graphite pre-impregnated composites. Preferably, the shaft 12 is made of metal. More preferably, it is made of steel, and even more preferably it is made of stainless steel. The shaft 12 must be of sufficient length so that it is at least as long as the photoconductive drum. The length of the shaft 12 and the photoconductive drum is determined by the width of the medium onto which an image is to be applied. A typical shaft 12 is from about 245 to about 400 millimeters in length. The outer diameter of the portion of the shaft 12 not covered by the roll core 14 can range from about 4 to about 9 millimeters, preferably about 6 to about 9 millimeters. More preferably, the shaft 12 diameter is about 6 millimeters. The shaft 12 can be made by any means known in the art, including extruding and/or machining.

The primary charge roller 10 also includes a roll core 14 which can be made of any material that is electrically conductive and also provides good wear characteristics. Preferably, the roll core 14 is made of a thermoplastic or thermoset polymer, preferably thermoplastic or thermoset polymer loaded with a conductive material, such as carbon. More preferably, it is made of a carbon loaded ethylene propylene terpolymer (EPDM), or carbon loaded styrene butadiene rubber (SBR). The roll core's (14) length is determined by the length of the shaft 12. It must be less than the length of the shaft 12. Typically, a roll core (14) length is from about 230 to about 380 millimeters. The outer diameter of the roll core 14 can range from about 10 to about 14 millimeters, preferably about 12 to about 14 millimeters.

Figure 2:
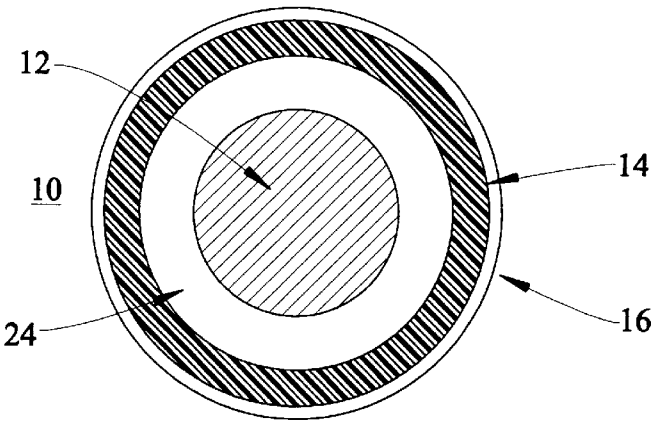
FIG. 2 is an end elevational view of the primary charge roller with a coating.

The primary charge roller 10 may further comprise a coating 16 on the outer surface of the roll core 14, as disclosed in U.S. Pat. No. 5,541,711, Kisu et al., issued Jul. 30, 1996, and incorporated herein by reference. See FIG. 2. Such a coating 16 comprises at least one conductive coating. The conductive coating provides a contact surface between the photoconductive drum and the primary charge roller 10. It reduces wear on the photoconductive drum. The conductive coating is preferably made of carbon loaded EPDM or Nylon. The coating may further comprise a resistive coating which can be made of a resistive rubber, preferably hydrin rubber. The coating must be applied so that the conductive layer contacts the photoconductive drum, in other words, the conductive layer must be the outer most layer. The coating ranges in thickness from about 3 to about 300 microns. The conductive coating preferably ranges from about 3 to about 10 microns in thickness. If a resistive layer is also applied, it preferably ranges in thickness from about 100 to about 300 microns.

Figure 1:
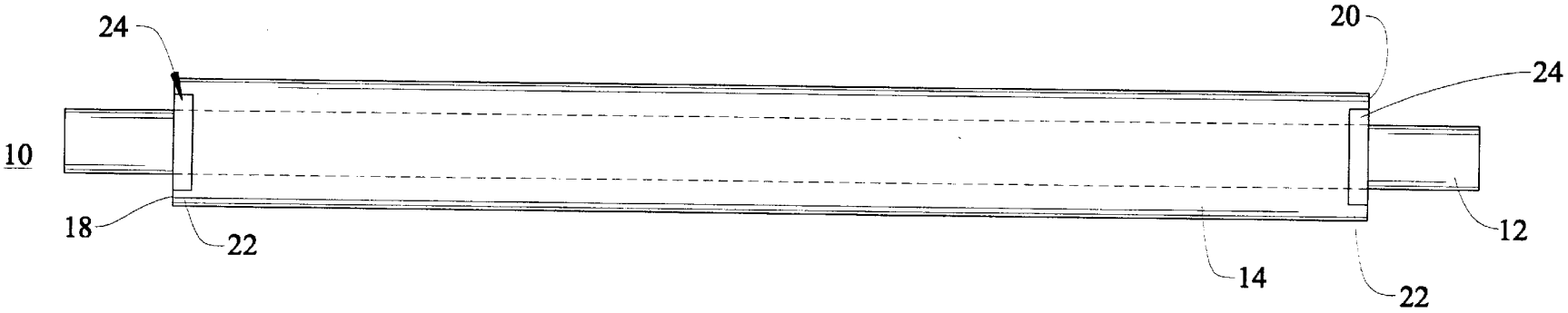
FIG. 1 is an elevational view of the primary charge roller.
Figure 5:
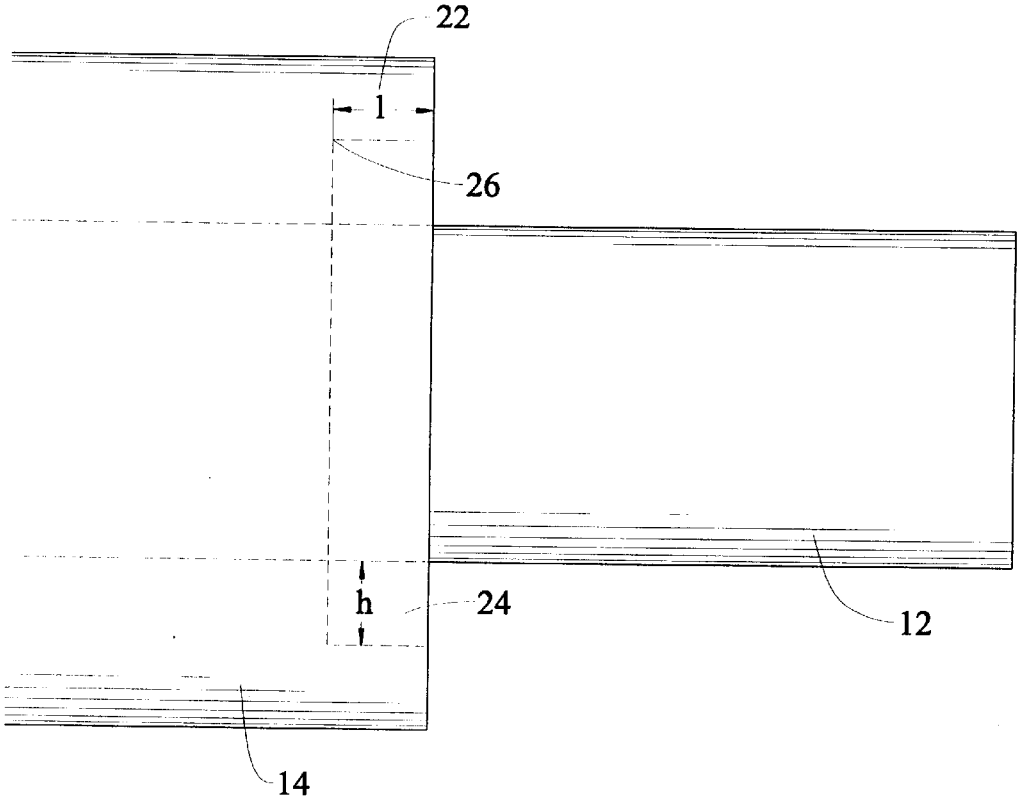
FIG. 5 is a fragmentary elevational view of the primary charge roller.
Figure 4:
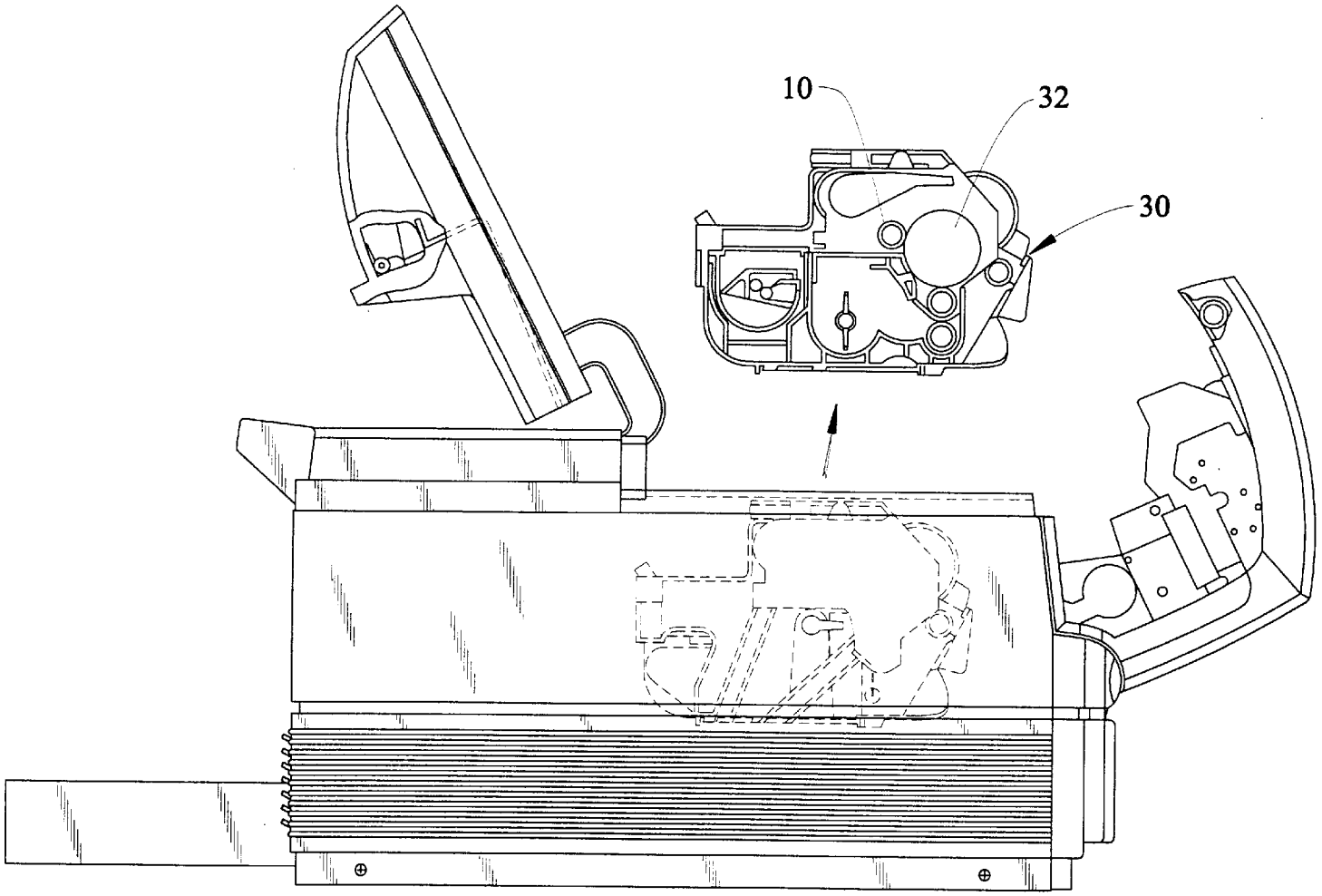
FIG. 4 is a side elevational view of a laser printer with the laser printer cartridge removed from the printer.

As shown in FIG. 1, the roll core 14 has two ends, a first end 18 and a second end 20. An annular lip 22 protrudes from at least one end of the roll core 14, thereby forming a gap 24 between the lip 22 and the shaft 12. The annular lip 22 is continuous and encircles the shaft. The gap is defined on two sides by the roll core 14 and on one side by the shaft 12; it is open on the fourth side. Preferably, the annular lip 22 protrudes from both ends of the roll core 14. This gap 24 allows the ends of the roll core 14 to bend away from the photoconductive drum when force is applied (i.e., when the drum and the primary charge roller 10 are in contact), thereby preventing excessive wear on the drum from the end comers of the primary charge roller 10. If the primary charge roller 10 has a coating 16, the coating 16 also covers the protruded lip 22. The inside corner 26 where the lip 22 contacts the core can be a radiused corner or it can be a square corner. See FIG. 5. The lip 22 can be of any thickness, so long as the lip 22 is sufficiently supported that it does not tear from the rest of the roll core 14 or wear away too quickly from its constant contact with the photoconductive drum. The thickness of the lip 22 is controlled by the height h of the gap 24 between the lip 22 and the shaft 12. The thickness of the lip 22 must be at least about 0.5 millimeters. Preferably the height h of the gap 24 is less than 30% of the outer diameter of the roll core 14. More preferably, the gap height h is approximately 15% of the outer diameter. For example, with a roll core 14 with a diameter of 12 millimeters, the gap 24 has a height h less than or equal to about 2.4 millimeters (so that the thickness of the lip 22 is at least 0.5 mm). More preferably, the gap 24 is approximately 1.7 to 1.9 millimeters.

The length l of the lip 22 should be sufficient to allow flexibility at the ends of the annular lip 22 so that it does not wear into the photoconductive drum. The length l of the lip 22 is limited only in that it cannot be so long that the distal end of the lip 22 flares out and contacts the photoconductive drum, instead of bending away from the drum. Preferably the length l of the lip 22 is approximately equal to the height h of the gap 24.

The roll core 14 can be attached to the shaft 12 by any means. Preferably, a conductive adhesive is applied to the shaft 12 before the roll core 14 is applied. The roll core 14 can be formed by molding or machining before it is attached to the shaft 12 or it can be molded or machined directly on the shaft 12. Preferably, the roll core 14 is molded onto the shaft 12. It can be subsequently machined after molding, if desired.

The annular lip 22 can be formed by any means known in the art. It can, for example, be molded into the core when the core is molded, or it can be machined into the core after the core has been formed. If the lip 22 is molded, it can be formed around a tool, such as an end cap, or an insert. Such an insert can be a removable insert, or it can be an insert which becomes part of the primary charge roller 10. For example, the core can be molded around an O-ring which becomes part of the primary charge roller 10.

If an insert, such as an O-ring, is meant to be permanent, the insert should be made of a soft material, i.e., it should have a hardness less than that of the roll core material. The permanent insert provides support for the lip 22, but is soft enough that it allows the lip 22 to bend away from the photoconductive drum. For example, if the roll core 14 is made of ethylene propylene terpolymer which has a Shore A hardness of approximately 38 to 46, the insert preferably has a Shore A hardness less than about 38 to 46. Preferably, the insert is made of a material with a Shore A hardness of less than about 30. More preferably, it is made of a material with a Shore A hardness of less than about 20. Suitable materials include low durometer silicones and rubbers, preferably SBR and EPDM that is unloaded or loaded with vegetable oil.

The primary charge roller 10 of the present invention can also be incorporated in replaceable printer cartridges 30. A typical cartridge 30 includes a photoconductive drum 32, a primary charge roller 10, toner and a development roller. In such a cartridge, the primary charge roller 10 is aligned within the cartridge 30 such that the primary charge roller 10 is in contact with the photoconductive drum 32 substantially along the length of the primary charge roller 10. Such printer cartridges 30 further can include toner and a development roller. Suitable toners and development rollers are well-known in the art; there is no limitation on the type of toner or development roller used in the present invention. Typically, toner is fine powder contained in a toner reservoir. Typically, a development roller uses magnetic or mechanical means to adhere a thin layer of toner to portions of the photoconductive drum.

What is claimed is:

1. A primary charge roller for charging a photoconductive drum comprising a shaft and a flexible, electrically conductive roll core disposed about said shaft and extending along a portion of the length of said shaft, said shaft having ends extending a predetermined distance past said core, wherein said roll core has first and second ends and wherein at least one of said ends of said roll core includes an annular lip extending axially over said shaft to form a gap between said roll core and said shaft, said annular lip completely encircling said shaft and being electrically conductive.

2. A primary charge roller in accordance with claim 1 wherein two of said ends of said roll core each include an annular lip extending axially over said shaft to form a gap between said roll core and said shaft, wherein each said annular lip completely encircles said shaft and is electrically conductive.

3. A primary charge roller in accordance with claim 2 wherein at least one of said gaps is filled with a material that has a Shore A hardness less than the Shore A hardness of the material from which the roll core is made.

4. A primary charge roller in accordance with claim 3 wherein at least one of said gaps is filled with a material that has a Shore A hardness less than or equal to about 30.

5. A primary charge roller in accordance with claim 4 wherein at least one of said gaps is filled with a material that has a Shore A hardness less than or equal to about 20.

6. A primary charge roller in accordance with claim 3 wherein at least one of said gaps is filled by an O-ring.

7. A primary charge roller in accordance with claim 2 wherein said primary charge roller further comprises at least one conductive coating.

8. A primary charge roller in accordance with claim 2 wherein said lip has a thickness of at least about 0.5 millimeters.

9. A primary charge roller in accordance with claim 2 wherein the height of said gap is less than or equal to about 15% of the outer diameter of the roll core.

10. A primary charge roller in accordance with claim 2 wherein the height of said gap is substantially equal to the length of the lip.

11. A laser printer cartridge comprising a photoconductive drum and a primary charge roller wherein said primary charge roller comprises a shaft and a flexible, electrically conductive roll core disposed about said shaft and extending along a portion of the length of said shaft, said shaft having ends extending a predetermined distance past said core, wherein said roll core has first and second ends and wherein at least one of said ends of said roll core includes an annular lip extending axially over said shaft to form a gap between said roll core and said shaft, said annular lip completely encircling said shaft and being electrically conductive.

12. A laser printer cartridge in accordance with claim 11 wherein two of said ends each include an annular lip extending axially over said shaft to form a gap between said roll core and said shaft, within said annular lip completely encircling said shaft and being electrically conductive.

13. A laser printer cartridge in accordance with claim 12 wherein said gaps are filled with a material that is softer than the material from which the roll core is made.

14. A laser printer cartridge in accordance with claim 13 wherein said gaps are filled with a material that has a Shore A hardness less than or equal to 30.

15. A laser printer cartridge in accordance with claim 14 wherein said gaps are filled with a material that has a Shore A hardness less than or equal to 20.

16. A laser printer cartridge in accordance with claim 13 wherein said gaps are filled by an O-ring.

17. A laser printer cartridge in accordance with claim 12 wherein said primary charge roller further comprises a coating.

18. A primary charge roller in accordance with claim 12 wherein said lip has a thickness of at least about 0.5 millimeters.

19. A primary charge roller in accordance with claim 12 wherein the height of said gap is less than or equal to about 15% of the outer diameter of the roll core.

20. A primary charge roller in accordance with claim 12 wherein the height of said gap is substantially equal to the length of the lip.

* * * * *